US006328663B1

(12) United States Patent
Lipstock

(10) Patent No.: US 6,328,663 B1
(45) Date of Patent: Dec. 11, 2001

(54) ADJUSTABLE GOLF BALL TEE

(76) Inventor: Elliot A. Lipstock, 276 Alden Rd., Fairhaven, MA (US) 02719

( * ) Notice: Subject to any disclaimer, the term of this patent is extended or adjusted under 35 U.S.C. 154(b) by 0 days.

(21) Appl. No.: 09/374,211

(22) Filed: Aug. 13, 1999

(51) Int. Cl.[7] ..... A63B 57/00
(52) U.S. Cl. ..... 473/396; 473/398
(58) Field of Search ..... 473/387, 403; D21/717, 718

(56) References Cited

U.S. PATENT DOCUMENTS

| | | | | |
|---|---|---|---|---|
| D. 306,751 | | 3/1990 | Orton . | |
| 1,803,907 | | 5/1931 | Kruse . | |
| 2,079,387 | | 5/1937 | Sickmiller . | |
| 2,693,358 | * | 11/1954 | Dawson, Jr. | 473/398 |
| 3,467,390 | | 9/1969 | Gardiner . | |
| 3,765,683 | | 10/1973 | Landry . | |
| 4,516,780 | | 5/1985 | Tabet . | |
| 5,156,403 | * | 10/1992 | Martino | 473/396 |
| 5,248,144 | | 9/1993 | Ullerich . | |
| 5,411,267 | | 5/1995 | Burks et al. . | |
| 5,415,409 | | 5/1995 | Hellmann . | |
| 5,470,074 | | 11/1995 | Hotchkiss et al. . | |
| 5,766,100 | * | 6/1998 | Dilmore | 473/396 |
| 5,776,014 | * | 7/1998 | Gustine | 473/396 |
| 6,083,121 | * | 7/2000 | Hovey | 473/396 |
| 6,086,486 | * | 7/2000 | Murphy et al. | 473/397 |

* cited by examiner

*Primary Examiner*—Steven Wong
(74) *Attorney, Agent, or Firm*—Peter F. Corless; Lisa Swiszcz Hazzard; Dike, Bronstein, Roberts & Cushman, IP Group

(57) ABSTRACT

An adjustable golf ball tee has a base embedded under a commercial mat and an adjustable support unit placed perpendicularly within the base through the aperture in the center of the base. The adjustable support unit comprises vertical ribs to absorb shock at impact from a golf club. A second support unit also capable of being adjusted in height is placed within the first unit. The lower end of the second unit has an arrowhead structure slightly larger than the width of the aperture of the first unit to prevent its disassociation from the first unit. The top end of the second unit has a concave structure in order to accommodate a golf ball. The first unit can be adjusted to a height beyond the top of the base. The second unit can be adjusted in height beyond the top of the first unit. The adjustable golf tee is made of synthetic material such as rubber or of thermoplastic material, which will endure repeated striking with a golf club.

5 Claims, 1 Drawing Sheet

ADJUSTABLE GOLF BALL TEE

BACKGROUND OF THE INVENTION

1. Field of the Invention

The present invention relates to a golf ball tee and more particularly to a simple and improved golf ball tee which is vertically adjustable by a telescopic mechanism utilizing two adjustable support units in order to accommodate golfers at driving ranges who tee up at different heights.

2. Background of the Invention

A standard rubber golf tee is fixed in length at driving ranges throughout the country. Height positioning of the tee is usually limited and attempts have been made to accommodate golfers who tee up at different heights both on the golf course and at driving ranges. Adjustable golf ball tees penetrating into the ground (see U.S. Pat. Nos. 3,467,390 and 4,516,780) and those with flat-bottom bases (see U.S. Pat. Nos. 1,803,907; 2,079,387; 5,248,144; and D306,751) have been developed. Adjustable golf tees have also been incorporated onto larger devices designed for automatic teeing (see U.S. Pat. Nos. 5,411,267 and 5,415,409). Still, limitations in height positioning exist in the prior art adjustable golf tee structures due to the impact the tee structures must endure. The present invention attempts to overcome this limitation by incorporating two adjustable support units into a simple golf tee structure, in contrast to the prior art structures which accommodate only a single adjustable structure, increasing the flexibility of height adjustment and durability of the present invention.

SUMMARY OF THE INVENTION

The present invention provides a simple adjustable golf ball tee for use on driving ranges. The general purpose of the present invention, which will be described subsequently in detail, is to provide a new and simple golf ball tee that is durable and adjustable in height by employing two adjustable units.

The adjustable units are supported by a base which is embedded under a commercial mat of the driving range. The first adjustable unit extends from the center of the base through an aperture of the base. The second adjustable support unit is placed within the first adjustable unit. The base and first adjustable units can have any shape and not necessarily the same shape. The lower end of the second adjustable unit has an arrowhead structure slightly larger than the aperture of the first adjustable unit from which it extends, and a concave structure at the top end to accommodate a golf ball thereon. Thus, the present invention provides increased flexibility to adjust the height of the golf ball tee by utilizing two support units adjustably mounted onto a base.

The present invention resides not in any one of these features, but rather in the particular combination of these features herein disclosed and claimed. This particular combination distinguishes the present invention from the prior art for the functions specified.

The present invention provides an adjustable golf ball tee which preferably has two adjustable units that allow adjustment in height by a telescopic mechanism.

The present invention also provides an adjustable golf ball tee which is durable and is able to endure repeated striking with a golf club.

The present invention further provides an adjustable golf ball tee that is simple in structure and therefore easy to manufacture.

The present invention also provides an adjustable golf ball tee that can be manufactured at low cost with synthetic material such as rubber or with thermoplastic material, which will endure repeated striking with a golf club.

Other embodiments of the adjustable golf ball tee will become apparent from the following description with reference to the accompanying drawing herein.

DESCRIPTION OF THE PREFERRED EMBODIMENT

Figure 1:
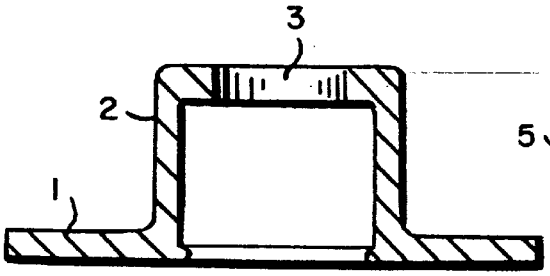
FIG. 1 is a side view of the base of the invention.

With reference to the drawings and in particular to FIGS. 1–4 thereof, an adjustable golf ball tee which is vertically adjustable by utilizing two adjustable support units, is described.

More specifically, the adjustable golf ball tee of the present invention comprises a base 2 having a planar bottom wall 1 of a predetermined first width with a rigid vertical support wall having a predetermined second width less than the first width, an adjustable first support unit 6 mounted adjustably through a central aperture 3 of said vertical support wall of base 2, and a second adjustable support unit 9 mounted adjustably through a central aperture 8 of first unit 6.

Figure 2:
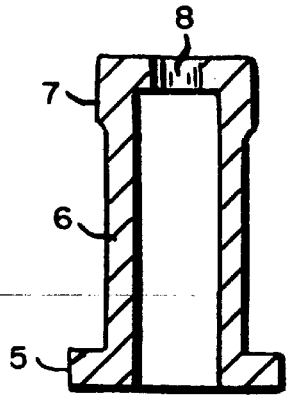
FIG. 2 is a side view of the first adjustable support unit of the invention.
Figure 3:
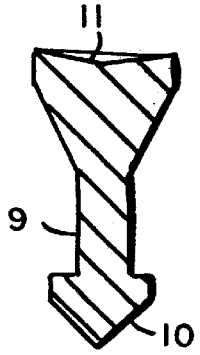
FIG. 3 is a side view of the second adjustable support unit of the invention.

The base plate 2 in FIG. 1 is preferably circular, but can be of any configuration as base plate 2 is preferably placed under a driving range mat 4. Similarly, first adjustable unit 6 and second adjustable unit 9 are preferably cylindrical, but can be of any configuration. The lower end 5 of adjustable first unit 6 in FIG. 2 is slightly larger in width than the central aperture 3 of vertical support wall of base 2 to prevent disassociation of adjustable first unit 6 from said base 2. At the top end of the adjustable first unit 6 is a plurality of vertical ribs 7 to absorb shock at impact with a golf club. The arrowhead structure 10 of adjustable second unit 9 in FIG. 3 has a width slightly larger than the central aperture 8 of adjustable first unit 6 to prevent disassociation of adjustable second unit 9 from adjustable first unit 6. At the top end of adjustable second unit 9 is a concave structure 11 to accommodate a golf ball.

Figure 4:
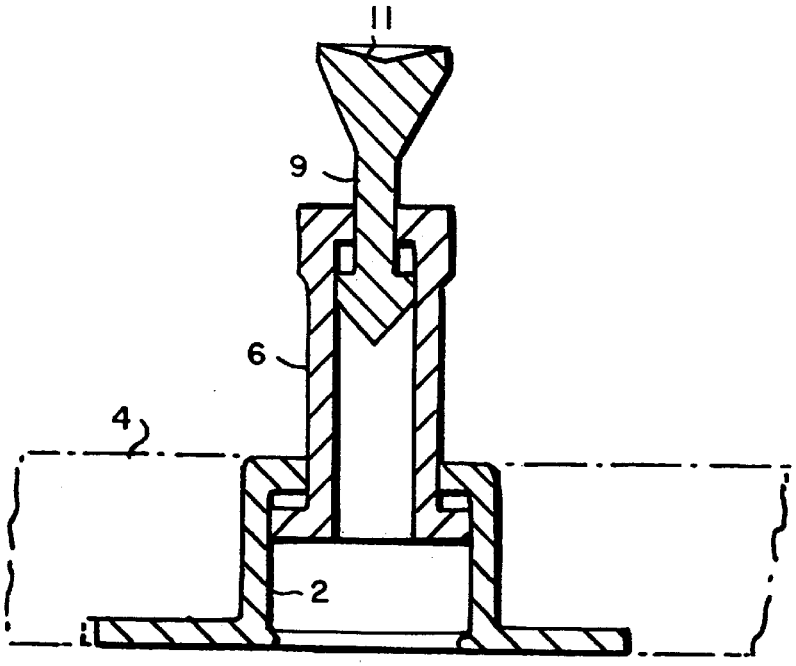
FIG. 4 is a side view of the assembled embodiment of the invention.

FIG. 4 depicts the assembled embodiment. In this manner, the first adjustable unit 6 is adjustable in height to extend beyond the top of base 2. The adjustable second unit 9 is also adjustable in height to extend beyond the top of first adjustable unit 6. Base 2 and first adjustable unit 6 are made of durable synthetic material, preferably rubber. Second adjustable unit 9 is made of a high strength thermoplastic material. The frictional nature of the rubber material allows for a firm grasp of first adjustable unit 6 and second adjustable unit 9 when positioned at a desired height. Other mechanisms for adjusting the heights of the adjustable units may be employed. For example, a locking mechanism in which one or more projections from the first adjustable unit 6 slides into narrow grooves of base 2 can be employed. The second adjustable unit 9 can be similarly locked in height by having projections from adjustable unit 9 slide into narrow grooves of adjustable unit 6. Thus, the golf ball tee is a simple structure and adjustable in height in a telescopic manner.

The dimensional relationships of each of the structures of the present invention are deemed readily apparent to those skilled in the art. Although not restricted to the following, a preferred dimension of predetermined first width of base 2 is about 2.5 inches. A preferred dimension of predetermined second width of said vertical support wall of base 2 is less than 2.5 inches. A preferred central aperture of said vertical support wall is about 0.5 inches in width. A preferred central aperture of first adjustable cylinder 6 is less than 0.5 inches in width.

Although not restricted to the following heights, the preferred height to which first adjustable unit 6 can extend beyond base 2 is about 0.75 inches and the preferred height to which second adjustable unit 9 can extend beyond top of first adjustable unit 6 is about 2 inches.

The foregoing descriptions are considered as illustrative only of the principles of the present invention. Thus, it will be appreciated that modifications and improvements within the spirit and teachings of the present invention may be made by those in the art upon considering the present disclosure.

What is claimed is:

1. An adjustable golf ball tee, comprising:

a) a base having an aperture in the center;

b) an open-ended first unit inserted perpendicularly into the aperture of said base and being adjustable in height to extend beyond the top of said base;

c) said first unit having a central aperture;

d) said first unit having a plurality of vertical rubber ribs to absorb shock upon impact; and e) a second unit placed within the aperture of said first unit and being adjustable in height to extend beyond the top of said first unit.

2. The adjustable golf ball tee of claim 1, wherein all the elements are made of synthetic material which will endure repeated striking with a golf club.

3. The adjustable golf ball tee of claim 1, wherein said base is adapted to lie embedded under a commercial mat.

4. The adjustable golf ball tee of claim 1, wherein said first unit includes a lower base which has a width greater than the width of the central aperture of said base to prevent its disassociation from said first base.

5. The adjustable golf ball tee of claim 1, wherein said second unit comprises:

a) an arrowhead structure at the lower end which is slightly larger than the central aperture of said first unit to prevent said second unit from disassociating from said first unit; and b) a concave structure at the top end to accommodate a golf ball.

* * * * *